United States Patent [19]

Adams, Jr.

[11] 4,167,133

[45] Sep. 11, 1979

[54] STRINGED MUSICAL INSTRUMENT NECK ADJUSTABLE TO COUNTERACT WARPING

[75] Inventor: Andrew B. Adams, Jr., General Deliver Box 844, Shepardstown, W. Va. 25443

[73] Assignee: Andrew Borden Adams, Jr., Shepardstown, W. Va.

[21] Appl. No.: 916,250

[22] Filed: Jun. 16, 1978

[51] Int. Cl.[2] ..... B10D 3/06

[52] U.S. Cl. ..... 84/293; 84/267

[58] Field of Search ..... 84/267, 293, 314

[56] References Cited

U.S. PATENT DOCUMENTS

| | | | |
|---|---|---|---|
| 516,717 | 3/1894 | Anderberg | 84/293 |
| 1,446,758 | 2/1923 | McHugh | 84/293 |
| 2,056,474 | 10/1936 | Low | 84/293 |
| 2,100,249 | 11/1937 | Hart | 84/293 |
| 2,460,943 | 2/1949 | Nelson | 84/293 |
| 2,998,742 | 9/1961 | Pratt | 84/293 |
| 3,143,028 | 8/1964 | Fender | 84/293 |
| 3,159,072 | 12/1964 | Burns et al. | 84/293 |
| 3,244,054 | 4/1966 | Berglund | 84/293 |
| 3,416,399 | 12/1968 | Baldoni | 84/293 |
| 3,901,119 | 8/1975 | Siminoff | 84/293 |

*Primary Examiner*—Lawrence R. Franklin

*Attorney, Agent, or Firm*—Stevens, Davis, Miller & Mosher

[57] ABSTRACT

A neck for a stringed instrument which is adjustable to counteract warping by tensioning a strap of substantially inextensible material positioned within the neck. In one embodiment, the strap is positioned inside a conduit inside the neck which can be bowed to counteract the warping. The strap is positioned in the conduit in the shape of an arc with the ends of the strap closer to the finger board or the strings than the central region of the strap by a plurality of rod members fixedly secured to the conduit. One end of the strap is fixedly secured to one end of the conduit and the other end can be moved to tension the strap and bow the conduit and neck to counteract warping. In another embodiment, the strap is shaped as an arc inside the conduit by an elongated filler element having an arcuate bottom surface which progressively increases in depth from the ends of the filler element toward the central region of it. In other embodiments, the strap is not disposed within a conduit but is held within the neck in the shape of an arc by filler elements placed in arcuate shaped channels in the neck.

13 Claims, 15 Drawing Figures

STRINGED MUSICAL INSTRUMENT NECK ADJUSTABLE TO COUNTERACT WARPING

BACKGROUND OF THE INVENTION

1. Field of the Invention

This invention relates to necks for musical instruments, and more particularly, to a novel structure adjustable to counteract warping of such necks.

2. Description of the Prior Art

Various structures have been provided for counteracting warping in necks of musical instruments. Some of them, such as that disclosed in U.S. Pat. No. 3,159,072, employ rods to counteract warping. Such rods are disadvantageous since tightening of them necessarily results in unnecessary torsion being placed upon the neck and possible consequential torsional distortion of it. In addition, such structure also transmits the tensional forces applied to the rod to counteract warping in the form of compressional forces on the neck. Since the necks are most commonly made of various types of wood which are not of uniform density throughout their extent, such compressional forces on the wood can produce undesired bowing of the neck at the weakest part of it. Furthermore, because of the required diameter of such rods, the amount of adjustability to counteract warping is limited because of the limited thickness of the neck in which the rod is positioned.

U.S. Pat. Nos. 516,717; 2,056,474; 2,100,249; 2,460,943; 3,143,028; 3,416,339 and 3,901,119 also disclose structure disposed within necks of musical instruments for counteracting warping thereof.

SUMMARY OF THE INVENTION

It is an object of this invention to effectively counteract warping caused by tension of the strings on a musical instrument or climatic effects on the wood or other material of which the neck is made.

Another object of this invention is to provide a structure within the neck which can be easily adjusted to apply force in any desired amount to counteract warping.

A further object of this invention is to provide a structure within the neck which does not place any undue torsional forces on the neck.

A further object of this invention is to provide a structure within the neck to counteract warping which will not place undue compressional forces on the wooden or other material of the neck.

A further object of this invention is to provide structure in the neck for counteracting warping of it which provides a greater amount of possible adjustability to counteract the warping.

A further object of this invention is to provide structure within the neck to counteract warping which is easily adjustable so that the neck can be straightened without having to disassemble the instrument.

These and other objects will become apparent from the following detailed description of the invention.

DESCRIPTION OF THE PREFERRED EMBODIMENTS

Figure 1:
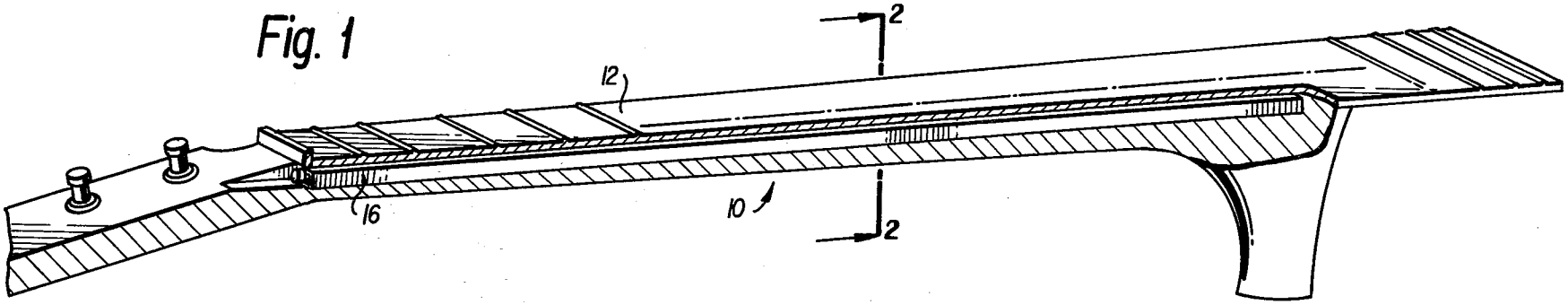
FIG. 1 is a perspective view, partly in section, of a first embodiment of the invention.

The first embodiment of the invention, shown in FIG. 1, includes a neck 10 for a stringed musical instrument such as a guitar. The neck includes a heel shown in the right-hand side of FIG. 1 and a peg box carrying pegs for the strings shown on the left-hand side of the figure. The neck can be made of plastic or wood, usually a hard wood such as mahogany or walnut. The neck is covered by a finger board 12 which can be made of plastic or close grain hard wood such as ebony or rosewood. When strings are placed over the neck board and secured to the pegs and tensioned, the tension, together at times with climatic conditions in which the stringed instrument is used, can cause the neck to bow upwardly or warp.

Figure 2:
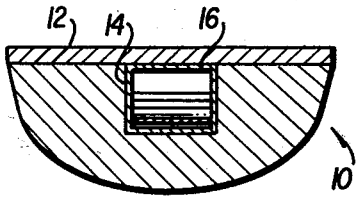
FIG. 2 is a cross-sectional view along the line 2—2 of FIG. 1.

As shown in FIGS. 1 and 2, a rectangular channel 14 is cut into the upper surface of the neck 10. A rectangular conduit 16 is disposed in the channel 14. The conduit 16 is made of a relatively rigid incompressible material such as aluminum, steel or hard plastic. The conduit, can be made, for example, of SAE 4130 steel tube 0.030 inch thick with a height of 0.4375 inch and a width of 0.5625 inch.

Disposed within the conduit 16 is a strap S which is made of a high strength substantially inextensible material such as steel. One possible material is 304 stainless steel which is one-half inch wide and 0.025 inch thick. The major transverse cross-sectional dimension of the strap S is parallel to the plane of the finger board 12.

Figure 3:
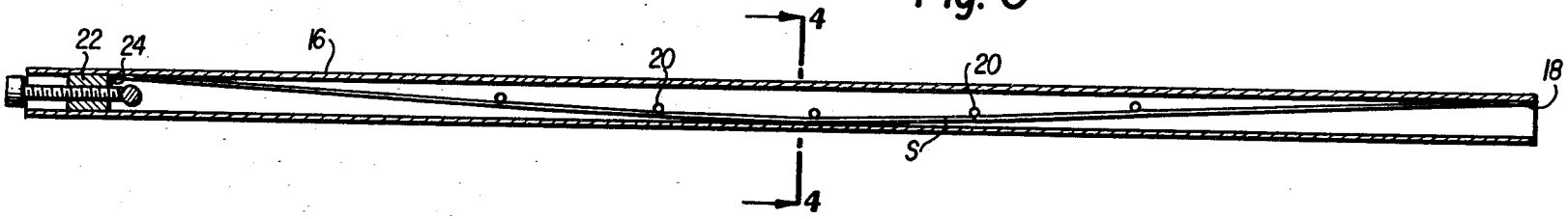
FIG. 3 is a longitudinal cross-sectional view of the conduit and related parts shown in FIG. 1.
Figure 4:
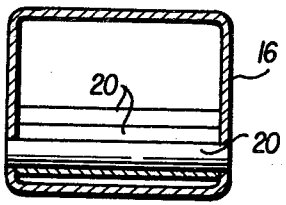
FIG. 4 is a cross-sectional view along the line 4—4 of FIG. 3.
Figure 5:
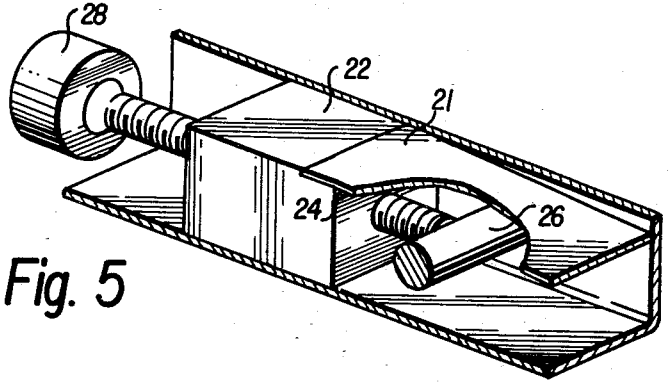
FIG. 5 is a detailed perspective view with some parts in section and some parts broken away for clarity showing the structure of the left-hand end of FIG. 3.

As shown in FIG. 3, one end of the strap is rigidly attached at 18 to the conduit, for example by welding or brazing. From that point, the strap extends over and is in contact with a plurality of transverse rod members 20 which are spaced along and rigidly secured to the conduit 16. The other end of the strap is fixedly connected at 21, for example by welding or brazing, to a block member 22 disposed within the conduit 16. The block member 22 is of rectangular cross-section slightly less than that of the conduit 16 and is internally threaded. The block member 22 cannot move further to the right in FIGS. 3 or 5 since such movement is blocked by an abutment member 24 integral with the conduit 16. The block 22 is positioned between the other end of the conduit 16 and an abutment rod 26 fixedly secured to the conduit 16. An externally threaded rotatable control member 28 is threadingly engaged with the internally threaded block 22 and has one end in abutment with the abutment rod 26.

When it is desired to counteract any warping which has occurred to the neck of the musical instrument so that it is bowed upwardly, such warping can be counteracted by tensioning the strap S to oppositely bow the conduit 16 and the neck 10. Since the strap S is fixedly attached at 18 to the conduit 16, counterclockwise rotation of the control member 28 (see FIG. 5) will cause the block 22 to move to the left in FIG. 2 and tension the substantially inextensible strap S. As a result, upward forces will be transmitted on the rods 20 and downward forces will be transmitted at 18 and 21 to the conduit 16 and the neck 10 to counteract the warping.

Figure 6:
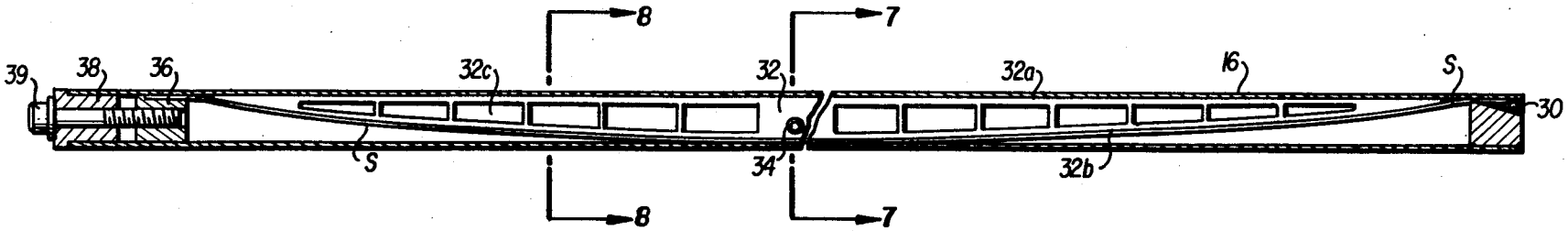
FIG. 6 is a view similar to FIG. 3 but of a second embodiment of the invention.
Figure 8:
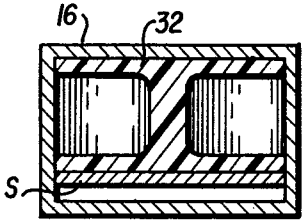
FIG. 8 is a cross-sectional view along the line 8—8 of FIG. 6.
Figure 7:
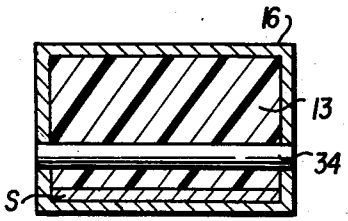
FIG. 7 is a cross-sectional view along the line 7—7 of FIG. 6.
Figure 9:
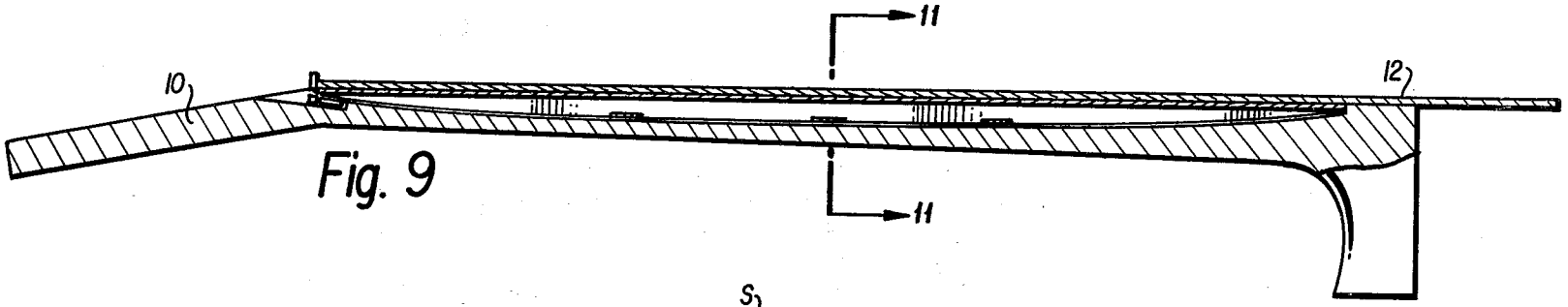
FIG. 9 is a cross-sectional view of a third embodiment of the invention.

The second embodiment of the invention is shown in FIGS. 6 through 8. This embodiment is substantially identical to the first except for the structure which positions the strap S within the conduit 16 and the structure which moves the one end of the strap to tension it.

As shown in FIG. 6, the strap S is secured at one end of the conduit 16 at 30 by means of a pin rigidly attached to that end of the conduit 16. The end of the strap could, of course, be fixedly secured by welding, brazing, etc. From the point 30, the strap extends downwardly toward the other end of the conduit over a filler member 32 rigidly secured to the conduit 16 by a pin 34. Both the conduit 16 and the filler member 32 are made of substantially rigid incompressible materials but are capable of being bowed. The filler member 32 includes a first substantially flat upper surface 32*a* which abuts against the interior of the top surface of the conduit 16 and an arcuate bottom surface 32*b* which progressively increases in depth from the ends thereof toward the central region adjacent the pin 34. The strap S extends along the bottom surface 32*b* in contact therewith and terminates at its other end which is fixedly secured, for example by welding or brazing, to a bearing block 36. The bearing block 36 is rectangular in cross-section and is of slightly less overall dimensions than the interior of the conduit 16 so as to be slidable therein. The bearing block 36 is internally threaded. On the other end of the conduit 16 is a cap member 38 which is rigidly attached to that end. A central bore extends through the cap member. As shown in FIG. 6, an externally threaded control member 39 has one enlarged end exterior of the conduit and in abutment with the cap member 38. The remainder of the control member 39 extends through the bore in the cap member 38 and its external threads are threadingly engaged with the internal threads in the bearing block 36.

As shown in FIG. 6, the filler member 32 may be cut out, for example as shown at 32*c* to decrease the overall weight of that member. Except at the sections 32*c*, the cross-section of the filler member 32 may be in the form of an I-beam as shown in FIG. 8.

The second embodiment of the invention functions in a manner similar to that of the first embodiment. When the neck of the guitar is warped as a result of tension of the strings or climatic conditions, such warping can be counteracted by rotating the control member 39 to move the bearing block 36 to the left as viewed in FIG. 6 to thereby tension the strap member S and apply an upward force to the central region at the bottom surface of the filler member 32 and downward forces at the ends of the strap S so that the conduit 16 and the neck 10 are bowed to counteract the warping.

The third embodiment of the invention is shown in FIGS. 9 through 12. In this embodiment, an elongated conduit is not employed. Instead, an arcuate channel is cut in the upper surface of the neck to accommodate a similarly shaped filler member 40 and the strap S. Alternatively, a channel rectangular in cross-section, like that shown in FIG. 1, could be provided for the guitar neck of this embodiment with the lower right and left-hand corners of that channel being filled by other filler members to fill the open areas in the channel not accommodated by the filler member 40 and strap S.

Figure 10:
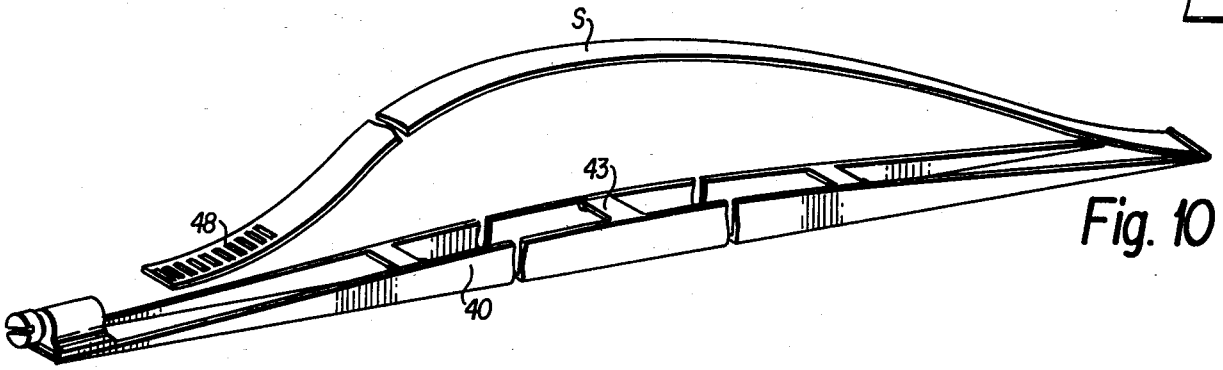
FIG. 10 is a perspective view of several parts shown in FIG. 9.
Figure 11:
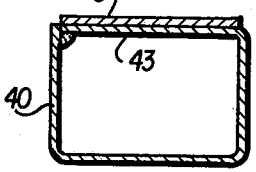
FIG. 11 is a cross-sectional view along the line 11—11 of FIG. 9.
Figure 12:
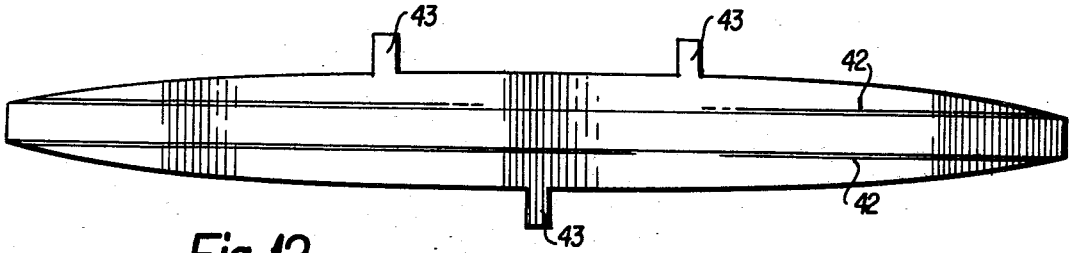
FIG. 12 is a plan view of one of the parts shown in FIG. 10 prior to forming.

As shown in FIG. 12, the filler 40 may be made from a blank piece of material which can be bent at right angles along lines 42 to define a channel and tabs 43 can be bent at right angles and welded or otherwise secured to the side members of the channel-shaped member 40. As shown in FIG. 10, the tabs 43 define a plurality of spaced abutment members. The strap S extends over and is in contact with the tabs or abutment members 43. The strap S is welded, brazed or otherwise fixedly secured to one end of the filler member 40. A conventional adjustable clamp 46 is fixedly secured to the other end of the filler member 40. The other end of the strap S is perforated as shown at 48 and extends through the clamp. When the screw of the clamp 46 is rotated, the strap S is pulled from right to left as shown in FIG. 10 and thereby tensioned. See tightening produces an upper force on the central region of the filler member 40 and downward forces at the ends of the strap to counteract undesired warping of the neck of the musical instrument.

The various parts shown in this third embodiment of the invention can be made of the materials discussed above with respect to the first two embodiments. The filler member 40 can be made for example of metal such as steel or aluminum.

Figure 13:
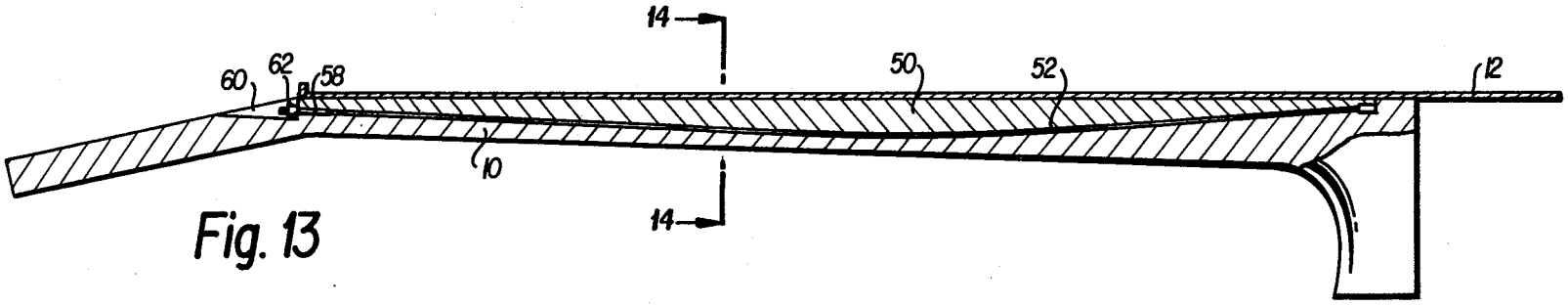
FIG. 13 is a cross-sectional view of a fourth embodiment of the invention.
Figure 14:
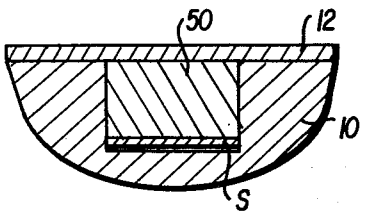
FIG. 14 is a cross-sectional view taken along the line 14—14 of FIG. 13.
Figure 15:
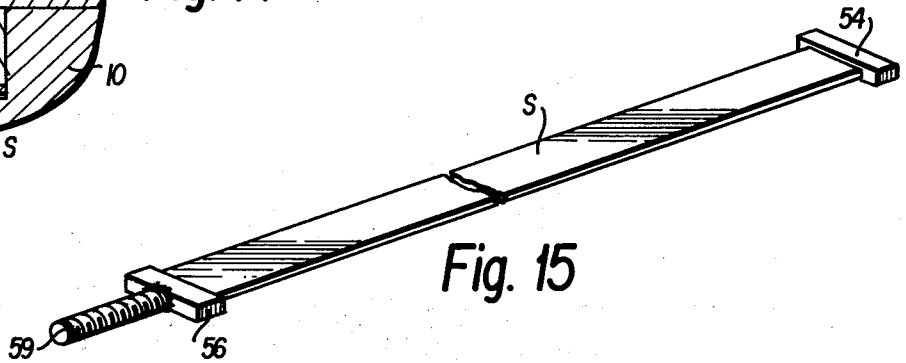
FIG. 15 is a perspective view of the strap and related components shown in FIG. 13.

The fourth embodiment of the invention is shown in FIGS. 13 through 15. As in the third embodiment, an arcuate channel is cut in the neck 10 to accommodate a filler member 50 and defines, with the remainder of the neck, a narrow slot 52 in which the strap S is positioned. As shown in FIG. 15, the ends of the strap are enlarged at 54 and 56. The end of 54 is fixedly secured to one end of the guitar neck 10 and the other end 56 is positioned in and movable along a similarly shaped channel 58. An externally threaded screw member 59 integrally connected to the end 56 protrudes outwardly into an opening 60 at the other end of the neck 10 and a nut 62 is threadingly engaged with the screw 59 and abuts the end of the channel 58.

In this embodiment, when the guitar neck is warped, the nut 62 may be further screwed onto the screw 59 to tension the strap S. As a result, downward forces will be applied on the neck 9 at the ends of the strap S and upward forces will be applied at the central region to counteract such warping.

The various parts shown in this fourth embodiment of the invention can be made for example of the materials discussed above with respect to the first three embodiments.

In all embodiments of the invention, a large amount of adjustment or tension can be applied to the strap S to counteract considerable warping of the neck. In addition, when a strap is used and positioned as shown in the drawings instead of a rod, a greater amount of adjustment is possible since the strap, because of its small thickness relative to the diameter of the rod, can be positioned lower in the neck to achieve a greater amount of adjustability. Also, with a strap, it should also be apparent that no undesired torsion is placed on the neck. Furthermore, with respect to the first three embodiments of the invention, it should be apparent that the tensile forces applied to the strap S are not transmitted to the neck 10 in the form of compression forces.

The term strap as used herein is meant to define a member of relatively uniform cross-sectional shape whose major lateral dimension is substantially greater than its major transverse dimension or thickness. Although straps of rectangular cross-section are disclosed, it is contemplated that straps with rounded ends or straps of elongated shape could be used.

Although only the end of the strap adjacent the peg board has been shown as adjustable it is contemplated in this invention that the end adjacent the heel only could be adjusted and that both ends could be adjusted to tension the strap.

What is claimed is:

1. A stringed musical instrument comprising: a neck; neck straightening means within said neck for countering warping of it due to the tension forces of said strings, said neck straightening means comprising (a) a strap whose major transverse cross-sectional dimension is substantially parallel to the plane of the strings, one end of said strap being secured adjacent one end of said neck and the other end of said strap being secured adjacent the other end of said neck, (b) means constraining said strap to a bowed configuration along its length, and (c) means for tensioning the strap along its length whereby upon tensioning, said strap coacts with said constraining means to produce forces upon said neck counter to said string tension forces.

2. A stringed musical instrument comprising a neck; and neck straightening means within said neck, said neck straightening means comprising a strap whose major transverse cross-sectional dimension is substantially parallel to the plane of the strings, one end of the strap being secured adjacent one end of said neck; means positioning said strap in the shape of an arc within said neck with the ends of the strap closer to the strings than the central region of the strap and for resisting movement of the strap in a direction directly toward the strings; and means for adjustably moving the other end of said strap relative to said neck away from the one end of the strap for tensioning the strap to overcome any warping of the neck.

3. A stringed instrument as claimed in claim 2, wherein:

said positioning and resisting means comprises an elongated filler element in the neck having an arcuate bottom surface which progressively increases in distance from the strings from the ends of the filler element toward the central region thereof; and said strap extends along the bottom surface in contact therewith.

4. A stringed musical instrument as claimed in claim 2, wherein:

said positioning and resisting means comprises an elongated filler element in the neck having a plurality of longitudinally spaced abutment members which progressively increase in distance from the strings from the ends of the filler element toward the central region thereof; and said strap extends over said abutment members in contact therewith.

5. A stringed musical instrument as claimed in claim 4, wherein:

said moving means is fixedly secured to the other end of said filler element and comprises a clamp through which the strap extends.

6. A stringed musical instrument as claimed in claim 5, wherein:

the one end of said strap is fixedly secured to one end of said filler element.

7. A stringed musical instrument comprising a neck; neck straightening means within said neck, said neck straightening means comprising a substantially straight elongated conduit extending from substantially one end of the neck to the other, a substantially longitudinally inextensible strap whose major transverse cross-sectional dimension is substantially parallel to the plane of the strings, means positioning said strap in the shape of an arc within said conduit with the ends of the strap closer to the strings than the central region thereof and for resisting movement of said strap in a direction directly toward said strings, one end of said strap being secured adjacent one end of said conduit and the other end of said strap being adjacent the other end of said conduit; and means for adjustably moving the other end of said strap relative to said conduit away from the one end of the strap for tensioning it to overcome any warping of the neck by oppositely bowing the conduit.

8. A stringed musical instrument comprising a neck; a finger board on said neck; and neck straightening means within said neck, said neck straightening means comprising an elongated self-supporting conduit substantially rectangular in transverse cross-section and of substantially rigid material but capable of being bowed; said conduit being non-rotatably positioned in said neck and extending from substantially one end of the neck to the other; a substantially longitudinally inextensible strap whose major transverse cross-sectional dimension is substantially parallel to the plane of the finger board, one end of the strap being secured adjacent one end of the conduit and the other end of the strap being positioned adjacent the other end of the conduit; means positioning said strap in the shape of an arc within said conduit with the ends of the strap closer to the finger board than the central region of the strap and for resisting movement of the strap in a direction directly toward the finger board; and means attached to the conduit for adjustably moving the other end of the strap relative to the conduit and the neck away from the one end of the strap for tensioning it to overcome any warping of the neck by oppositely bowing the conduit.

9. A stringed musical instrument as claimed in claim 8, wherein:

said moving means comprises:

an abutment member fixedly secured within said conduit adjacent the other end thereof;

an internally threaded block of rectangular transverse cross-section slightly less than that of said conduit positioned in the other end of the conduit; said block being between the abutment member and the other end of the conduit and having the other end of the strap fixedly secured thereto; and an externally threaded rotatable control member threadingly engaged with the internally threaded block and having one end in abutment with the abutment member whereby when the control member is rotated said block and the other end of the strap secured thereto move toward the other end of the conduit and the strap is tensioned.

10. A stringed musical instrument as claimed in claim 8, wherein:

said moving means comprises:

a bored cap fixedly secured to the other end of the conduit;

an internally threaded bearing block of rectangular transverse cross-section slightly less than that of said conduit and slidably movable therein, said block having the other end of said strap fixedly secured thereto; and an externally threaded control member having one end exterior of said conduit and in abutment with the cap, extending through the bore in the cap and threadingly engaged with the internal threaded bearing block whereby when the control member is rotated said block and the other end of the strap secured thereto move toward the other end of the conduit and the strap is tensioned.

11. A stringed musical instrument as claimed in claim 8, wherein said positioning and resisting means comprises a plurality of rod members fixedly secured at spaced intervals in an arc along the conduit; and said strap extends over said rod members in contact therewith.

12. A stringed musical instrument as claimed in claim 8, wherein:

said positioning and resisting means comprises an elongated filler element in said conduit and of a length slightly less than that of the conduit, said filler element having a first flat upper surface in abutment with the interior of the top of the conduit and a second arcuate bottom surface which progressively increases in depth from the ends of the filler element toward the central region thereof; and said strap extends along the bottom surface of the filler element in contact therewith.

13. A stringed musical instrument as claimed in claim 12, wherein:

said filler element is fixedly secured to said conduit.

* * * * *

Disclaimer 4,167,133.—*Andrew B. Adams, Jr.*, Shepardstown, W. Va. STRINGED MUSICAL INSTRUMENT NECK ADJUSTABLE TO COUNTERACT WARPING. Patent dated Sept. 11, 1979. Disclaimer filed Apr. 8, 1980, by the inventor.

Hereby enters this disclaimer to claims 1 through 6 of said patent.

[*Official Gazette, June 17, 1980.*]